US008876556B2

(12) United States Patent
Wu

(10) Patent No.: US 8,876,556 B2
(45) Date of Patent: Nov. 4, 2014

(54) LIGHT HEAD AND LAMP USING THE SAME AND ASSEMBLING METHOD OF LIGHT HEAD

(75) Inventor: Hsien-Chang Wu, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 202 days.

(21) Appl. No.: 13/541,634

(22) Filed: Jul. 3, 2012

(65) Prior Publication Data

US 2013/0083548 A1 Apr. 4, 2013

(30) Foreign Application Priority Data

Oct. 4, 2011 (TW) ..... 100135892 A

(51) Int. Cl.
*H01J 5/50* (2006.01)
*H01J 5/52* (2006.01)

(52) U.S. Cl.
CPC ..... *H01J 5/52* (2013.01)
USPC ..... 439/611; 439/616; 362/650

(58) Field of Classification Search
USPC ..... 439/611–617; 362/362, 382, 396, 650
See application file for complete search history.

(56) References Cited

U.S. PATENT DOCUMENTS

| | | | | |
|---|---|---|---|---|
| 4,975,813 | A * | 12/1990 | Chen | 362/650 |
| 7,211,955 | B2 | 5/2007 | Meguro et al. | |
| 8,753,000 | B2 * | 6/2014 | Wu | 362/650 |
| 2011/0157903 | A1 * | 6/2011 | Trewin | 362/418 |
| 2013/0176734 | A1 * | 7/2013 | Fussell | 362/249.02 |

* cited by examiner

*Primary Examiner* — Khiem Nguyen
(74) *Attorney, Agent, or Firm* — Jianq Chyun IP Office

(57) ABSTRACT

A light head, a lamp using the light head, and an assembling method of the light head are provided. The lamp includes the light head, a circuit board, a light source, and a light cover. The circuit board is disposed on the light head and electrically connected to the light source. The light cover is assembled to the light head. The circuit board and the light source are located in the light cover. The light head includes a first assembling element, a second assembling element, first pins, and a second pin. The first assembling element has an axial direction and a radial direction. The second and first assembling elements are telescoped and are coaxial. The first pins pass through the first assembling element along the axial direction, and the second pin passes through the first and second assembling elements along the radial direction.

14 Claims, 3 Drawing Sheets

LIGHT HEAD AND LAMP USING THE SAME AND ASSEMBLING METHOD OF LIGHT HEAD

CROSS-REFERENCE TO RELATED APPLICATION

This application claims the priority benefit of Taiwan application serial no. 100135892, filed on Oct. 4, 2011. The entirety of the above-mentioned patent application is hereby incorporated by reference herein and made a part of this specification.

BACKGROUND OF THE INVENTION

1. Field of the Invention

The invention relates to a light head, a lamp, and an assembling method. More particularly, the invention relates to a light head with an intact exterior, a lamp using the light head, and an assembling method of the light head.

2. Description of Related Art

Normal lamps are often equipped with light heads that are inserted into light stands for electrical connection. FIG. 1 is a schematic view illustrating a light head structure of a conventional lamp. With reference to FIG. 1, the process of assembling the light head 110 of the conventional lamp 100 is rather complicated. For instance, components are assembled together through performing a dotting process, and the electrical contact 120 is then soldered. Namely, the assembling operation is rather complex and inconvenient.

SUMMARY OF THE INVENTION

The invention is directed to a light head of a lamp with an intact exterior.

The invention is directed to a lamp using the aforesaid light head.

The invention is directed to an assembling method of a light head of a lamp; by applying the assembling method, the assembling operation can be completed with ease.

In order to achieve the above-mentioned or other objectives, the invention provides a light head of a lamp. The light head includes a first assembling element, a second assembling element, a plurality of first pins, and a second pin. The first assembling element has an axial direction and a radial direction. The second assembling element and the first assembling element are telescoped, and the second assembling element is coaxial with the first assembling element. The first pins pass through the first assembling element along the axial direction. The second pin passes through the first assembling element and the second assembling element along the radial direction, so as to fix the first and second assembling elements together.

In order to achieve the above or other objectives, the invention further provides a lamp using the light head. The lamp includes the light head, a circuit board, a light source, and a light cover. The circuit board is disposed on the light head and electrically connected to the light source. The light cover is assembled to the light head, and the circuit board and the light source are located in the light cover.

According to an embodiment of the invention, the first assembling element and the second assembling element are hollow cylinders.

According to an embodiment of the invention, one of the first assembling element and the second assembling element is made of plastic, and the other one of the first assembling element and the second assembling element is made of metal.

According to an embodiment of the invention, the first assembling element further has an outer surface and a positioning portion, and the positioning portion is located on the outer surface to stop the second assembling element.

According to an embodiment of the invention, the second pin includes a pin stud and a metal member. The metal member surrounds the pin stud, the pin stud is telescoped into the metal member, and two ends of the pin stud protrude from the metal member.

According to an embodiment of the invention, the first pins are made of metal. Each of the first pins has a pin head and a through portion connected to each other. The through portion is inserted into the first assembling element, and the pin head is exposed by the first assembling element.

In order to achieve the above or other objectives, the invention further provides an assembling method of a light head of a lamp. The assembling method at least includes following steps. A first assembling element, a second assembling element, and a plurality of first pins are provided. Here, the first assembling element and the second assembling element are hollow cylinders. The first assembling element and the second assembling element are telescoped. The first pins are stuck into the first assembling element along an axial direction of the first assembling element. A second pin is provided. The second pin passes through the first assembling element along a radial direction of the first assembling element from one end of the second assembling element to the other end of the second assembling element, so as to fix the first assembling element and the second assembling element together.

The invention further provides an assembling method of a light head of a lamp. The assembling method at least includes following steps. A first assembling element, a second assembling element, and a plurality of first pins are provided. Here, the first assembling element and the second assembling element are hollow cylinders. The first pins are stuck into the first assembling element along an axial direction of the first assembling element. The first assembling element and the second assembling element are telescoped. A second pin is provided. The second pin passes through the first assembling element along a radial direction of the first assembling element from one end of the second assembling element to the other end of the second assembling element.

The invention further provides an assembling method of a light head of a lamp. The assembling method at least includes following steps. A first assembling element, a second assembling element, and a plurality of first pins are provided. Here, the first assembling element and the second assembling element are hollow cylinders. The first assembling element and the second assembling element are telescoped. A second pin is provided. The second pin passes through the first assembling element along a radial direction of the first assembling element from one end of the second assembling element to the other end of the second assembling element. The first pins are stuck into the first assembling element along an axial direction of the first assembling element.

According to an embodiment of the invention, a method of forming the second pin comprises over-molding.

Based on the above, the light head is assembled without performing a soldering process, and thus components relatively located at the outer side need not undergo the dotting and soldering processes. Namely, the light head and the lamp using the light head are more eye-catching and exquisite than the conventional light head on which the dotting and soldering processes need be performed. Additionally, the pins can be directly stuck into the first assembling element, so as to assemble the two assembling elements. Hence, in comparison with the assembly of the conventional light head that requires the dotting process for fixing the two assembling elements to each other prior to the soldering process, the assembly of the light head described in the embodiments of the invention can be done with one less step. Namely, the light head of the invention can be assembled with ease, and relevant costs can be reduced.

Several exemplary embodiments accompanied with figures are described in detail below to further describe the invention in details.

BRIEF DESCRIPTION OF THE DRAWINGS

The accompanying drawings are included to provide a further understanding of the disclosure, and are incorporated in and constitute a part of this specification. The drawings illustrate exemplary embodiments of the invention and, together with the description, serve to explain the principles of the invention.

DETAILED DESCRIPTION OF DISCLOSED EXEMPLARY EMBODIMENTS

Figure 1:
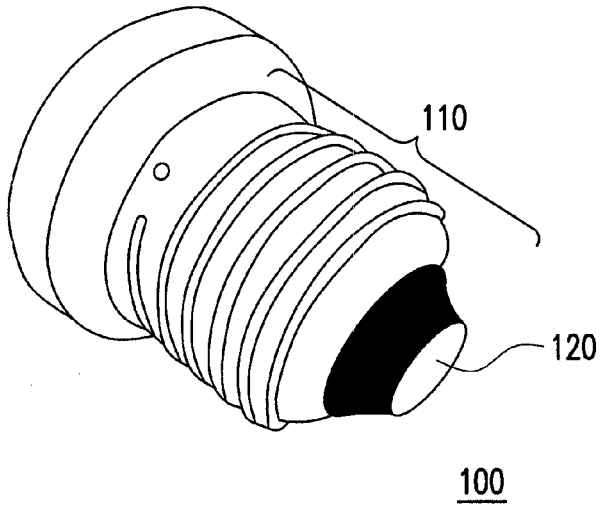
FIG. 1 (PRIOR ART)
FIG. 1 is a schematic view illustrating a light head structure of a conventional lamp.
Figure 2:
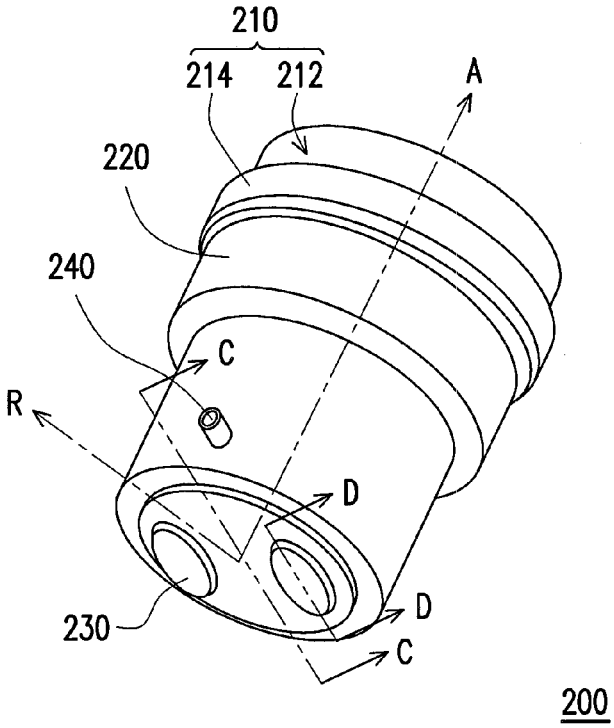
FIG. 2 is a schematic view illustrating a light head according to an embodiment of the invention.
Figure 3:
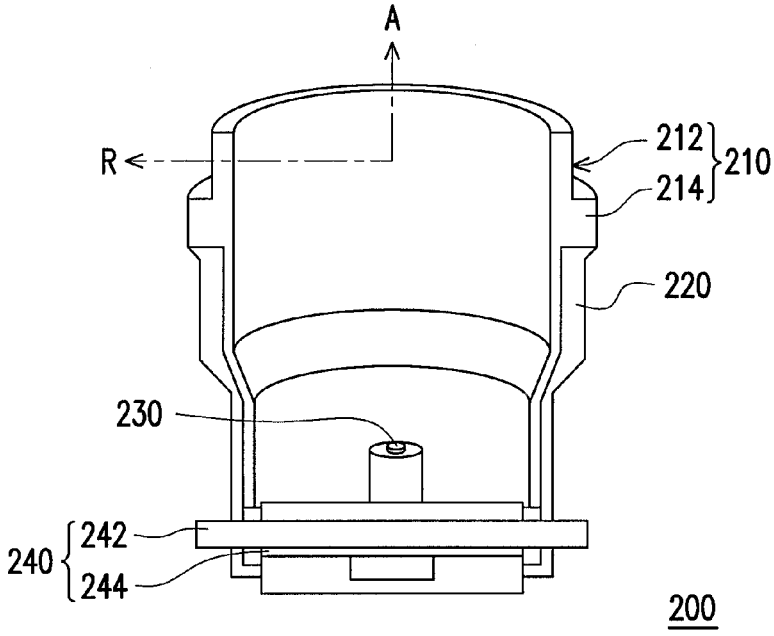
FIG. 3 is a schematic cross-sectional view taken along a sectional line C-C depicted in FIG. 2.
Figure 4:
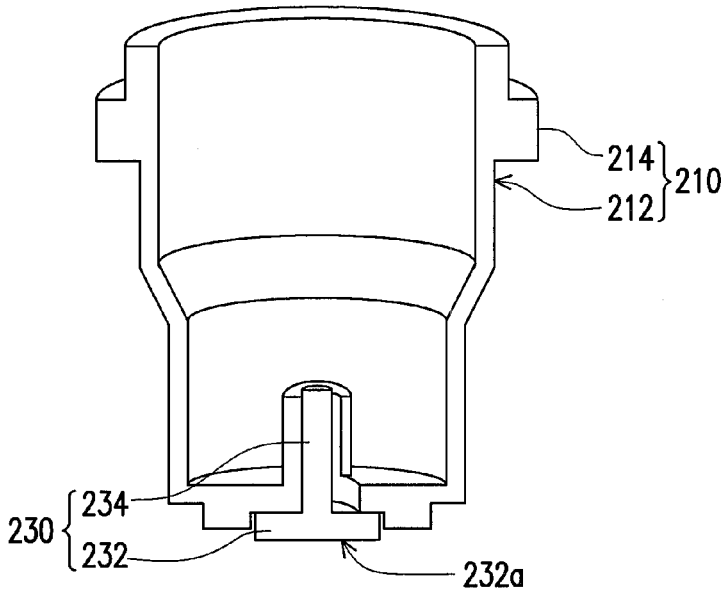
FIG. 4 is a schematic cross-sectional view taken along a sectional line D-D depicted in FIG. 2.

FIG. 2 is a schematic view illustrating a light head according to an embodiment of the invention. FIG. 3 is a schematic cross-sectional view taken along a sectional line C-C depicted in FIG. 2. FIG. 4 is a schematic cross-sectional view taken along a sectional line D-D depicted in FIG. 2. With reference to FIG. 2, FIG. 3, and FIG. 4, the light head 200 includes a first assembling element 210, a second assembling element 220, a plurality of first pins 230, and a second pin 240. The first assembling element 210 and the second assembling element 220 are hollow cylinders. The first assembling element 210 has an axial direction A and a radial direction R. The second assembling element 220 and the first assembling element 210 are telescoped and coaxial. The first pins 230 pass through the first assembling element 210 along the axial direction A. The second pin 240 passes through the first assembling element 210 and the second assembling element 220 along the radial direction R, so as to fix the first and second assembling elements 210 and 220 together.

In this embodiment, the first assembling element 210 is made of plastic, the second assembling element 220 is made of metal, and the first assembling element 210 is telescoped into the second assembling element 220. The first assembling element 210 can be formed by injection molding. Therefore, the first assembling element 210 can be integrally formed, and the manufacturing steps of the first assembling element 210 can be simplified. Besides, the first assembling element 210 is telescoped into the second assembling element 220 made of metal, and the second assembling element 220 can serve to protect the first assembling element 210 and enhance the overall strength of the light head 200.

The first assembling element 210 further has an outer surface 212 and a positioning portion 214. The positioning portion 214 is located on the outer surface 212 and protrudes from the outer surface 212 for stopping the second assembling element 220. The first pins 230 are made of metal, and each of the first pins 230 has a pin head 232 and a through portion 234 that are connected to each other. The through portion 234 is inserted into the first assembling element 210, and the pin head 232 is exposed by the first assembling element 210. The second pin 240 includes a pin stud 242 and a metal member 244. The metal member 244 surrounds the pin stud 242, the pin stud 242 is telescoped into the metal member 244, and two ends of the pin stud 242 protrude from the metal member 244. The metal member 244 can be formed together with the first assembling element 210 by over-molding.

Figure 5:
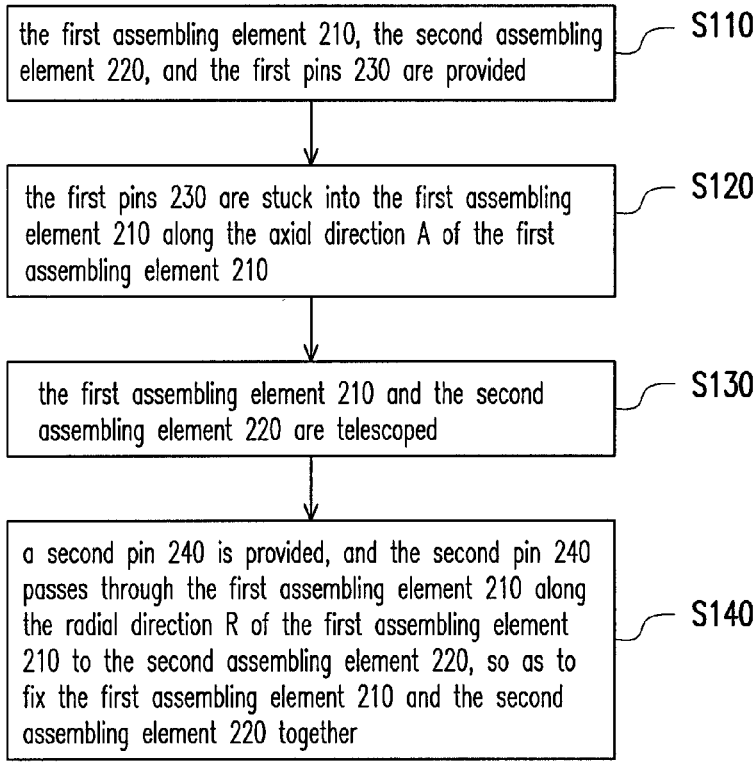
FIG. 5 is a flowchart illustrating an assembling method of the light head shown in FIG. 2.

An assembling method of the light head 200 is described hereinafter. FIG. 5 is a flowchart illustrating an assembling method of the light head shown in FIG. 2. With reference to FIG. 3 and FIG. 5, the assembling method of the light head 200 in this embodiment at least includes following steps. In step S110, the first assembling element 210, the second assembling element 220, and the first pins 230 are provided. In step S120, the first pins 230 are stuck into the first assembling element 210 along the axial direction A of the first assembling element 210. Here, the through portion 234 of each first pin 230 is located in the first assembling element 210, while the pin head 232 is exposed by the first assembling element 210. The first pins 230 serve to fix wires, and the first pins 230 conduct electricity. In step S130, the first assembling element 210 and the second assembling element 220 are telescoped. Here, the first assembling element 210 made of plastic is telescoped into the second assembling element 220 made of metal. The positioning portion 214 of the first assembling element 210 stops the second assembling element 220, such that the second assembling element 220 can be accurately placed at the assembling location. In step S140, a second pin 240 is provided, and the second pin 240 passes through the first assembling element 210 along the radial direction R of the first assembling element 210 from one end of the second assembling element 220 to the other end of the second assembling element 220, so as to fix the first assembling element 210 and the second assembling element 220 together.

Note that the assembling steps S110~S140 are merely exemplary, and people having ordinary skill in the art can modify the sequence of performing the assembling steps S110~S140 based on actual requirement. For instance, after step S110, step S130 can be performed to telescope the first and second assembling elements 210 and 220. After that, step S120 is performed to stick the first pins 230 into the first assembling element 210, and step S140 is performed to fix the first and second assembling elements 210 and 220 together.

Alternatively, after step S110, step S130 can be performed to telescope the first and second assembling elements 210 and 220. After that, step S140 is performed, such that the second pin 240 passes through the first assembling element 210 along the radial direction R of the first assembling element 210 from one end of the second assembling element 220 to the other end of the second assembling element 220, and step S120 is performed to stick the first pins 230 into the first assembling element 210 along the axial direction A of the first assembling element 210.

As indicated above, no dotting process is implemented to assemble the first and second assembling elements 210 and 220. Instead, the first pins 230 are stuck into the first assembling element 210, and the second pin 240 passes through the first and second assembling elements 210 and 220, so as to fix the first and second assembling elements 210 and 220 together. Therefore, the exterior of the second assembling element 220 remains intact, and the light head 200 does not have holes caused by performing the dotting process. As such, the undamaged light head 200 is rather artistic. Besides, the first and second assembling elements 210 and 220 are fixed together the second pin 240 that passes through the first and second assembling elements 210 and 220. Namely, the way to fix the first and second assembling elements 210 and 220 together is easier than the conventional dotting and soldering processes, and the assembly strength is relatively large in this invention. Hence, the assembly of the first and second assembling elements 210 and 220 can pass the torsion inspection, and the way to assemble the light head 220 in this embodiment is more convenient to the assembly staff.

Figure 6:
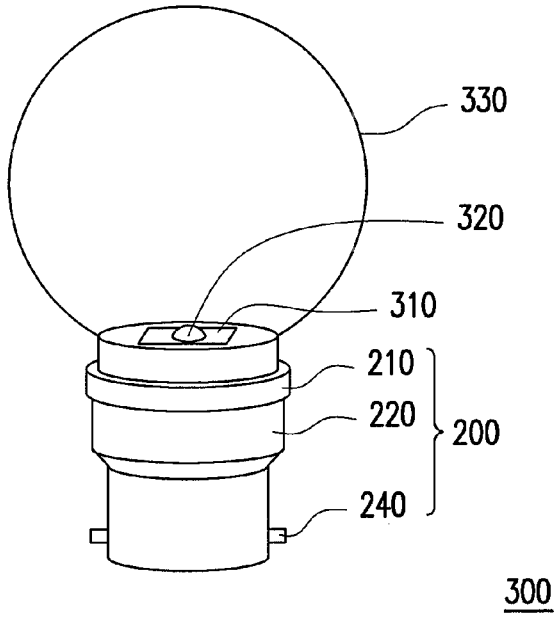
FIG. 6 is a schematic view illustrating assembly of a lamp using the light head depicted in FIG. 2.

FIG. 6 is a schematic view illustrating assembly of a lamp using the light head depicted in FIG. 2. With reference to FIG. 6, the lamp 300 includes the light head 200, a circuit board 310, a light source 320, and a light cover 330. The circuit board 310 is disposed on the light head 200 and electrically connected to the light source 320. In this embodiment, the light source 320 is directly disposed on the circuit board 310. The light cover 330 is assembled to the light head 200 and covers the circuit board 310 and the light source 320, i.e., the circuit board 310 and the light source 320 are located in the light cover 330. Note that the configuration of the circuit board 310, the light source 320, and the light cover 330 is merely exemplary, and people having ordinary skill in the art can make necessary changes based on actual requirement and should not be limited by the present embodiment.

Since the light head 200 has the intact exterior and can be assembled with ease, the lamp 300 using the light head 200 also has the intact exterior and can be easily assembled.

In light of the foregoing, the assembling process of the first and second assembling elements of the light head completely excludes the dotting process. Thereby, the exterior of the second assembling element remains intact, and the exterior of the light head is undamaged and consistently artistic. Moreover, in this invention, the first and second assembling elements of the light head are fixed together by the second pin that passes through the first and second assembling elements. Namely, in comparison with the conventional dotting and soldering processes, the way to fix the first and second assembling elements together leads to a relatively large assembly strength, and the assembly of the first and second assembling elements can pass the torsion inspection. Further, in this invention, the second pin passes through both the first assembling element and the second assembling element, such that the first and second assembling elements can be fixed together in a simpler and more convenient manner than the conventional dotting and soldering processes. As a result, in the invention, the assembly of the light head is more convenient to the assembly staff.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A light head of a lamp, comprising:

a first assembling element having an axial direction and a radial direction;

a second assembling element, the second assembling element and the first assembling element being telescoped and coaxial;

a plurality of first pins passing through the first assembling element along the axial direction; and a second pin passing through the first assembling element and the second assembling element along the radial direction, so as to fix the first and second assembling elements together.

2. The light head of the lamp as recited in claim 1, wherein the first assembling element and the second assembling element are hollow cylinders.

3. The light head of the lamp as recited in claim 1, wherein one of the first assembling element and the second assembling element is made of plastic, and the other one of the first assembling element and the second assembling element is made of metal.

4. The light head of the lamp as recited in claim 1, wherein the first assembling element further has an outer surface and a positioning portion, and the positioning portion is located on the outer surface to stop the second assembling element.

5. The light head of the lamp as recited in claim 1, wherein the second pin comprises:

a pin stud; and a metal member surrounding the pin stud, the pin stud being telescoped into the metal member, two ends of the pin stud protruding from the metal member.

6. The light head of the lamp as recited in claim 1, wherein the first pins are made of metal.

7. The light head of the lamp as recited in claim 6, wherein each of the first pins has a pin head and a through portion connected to each other, the through portion is inserted into the first assembling element, and the pin head is exposed by the first assembling element.

8. A lamp comprising:

a light head comprising:

a first assembling element having an axial direction and a radial direction;

a second assembling element, the second assembling element and the first assembling element being telescoped and coaxial;

a plurality of first pins passing through the first assembling element along the axial direction;

a second pin passing through the first assembling element and the second assembling element along the radial direction, so as to fix the first and second assembling elements together;

a circuit board disposed on the light head;

a light source electrically connected to the circuit board; and a light cover assembled to the light head, the circuit board and the light source being located in the light cover.

9. The lamp as recited in claim 8, wherein the first assembling element and the second assembling element are hollow cylinders.

10. The lamp as recited in claim 8, wherein one of the first assembling element and the second assembling element is made of plastic, and the other one of the first assembling element and the second assembling element is made of metal.

11. The lamp as recited in claim 8, wherein the first assembling element further has an outer surface and a positioning portion, and the positioning portion is located on the outer surface to stop the second assembling element.

12. The lamp as recited in claim 8, wherein the second pin comprises:

a pin stud; and a metal member surrounding the pin stud, the pin stud being telescoped into the metal member, two ends of the pin stud protruding from the metal member.

13. The lamp as recited in claim 8, wherein the first pins are made of metal.

14. The lamp as recited in claim 13, wherein each of the first pins has a pin head and a through portion connected to each other, the through portion is inserted into the first assembling element, and the pin head is exposed by the first assembling element.

* * * * *